United States Patent [19]

Frank

[11] Patent Number: 4,691,913

[45] Date of Patent: Sep. 8, 1987

[54] SEPARATING APPARATUS FOR FLAT OBJECTS

[75] Inventor: Werner Frank, Insel Reichenau, Fed. Rep. of Germany

[73] Assignee: Licentia Patent-Verwaltungs-GmbH, Fed. Rep. of Germany

[21] Appl. No.: 801,147

[22] Filed: Nov. 22, 1985

[30] Foreign Application Priority Data

Dec. 5, 1984 [DE] Fed. Rep. of Germany ..... 3444335

[51] Int. Cl.[4] ..... B65H 3/04

[52] U.S. Cl. ..... 271/34; 271/150

[58] Field of Search ..... 271/34, 10, 149, 150, 271/151, 903, 31.1, 237, 238, 270, 149, 202, 126, 18, 248; 198/454, 453, 443, 461

[56] References Cited

U.S. PATENT DOCUMENTS 4,098,458 7/1978 Auchinleck ..... 271/248 X

FOREIGN PATENT DOCUMENTS 2030116 4/1980 United Kingdom ..... 271/202

2113659 8/1983 United Kingdom ..... 271/202

*Primary Examiner*—Joseph J. Rolla
*Assistant Examiner*—Nils Pedersen
*Attorney, Agent, or Firm*—McGlew and Tuttle

[57] ABSTRACT

A singling apparatus for letters, vouchers, receipts, checks, punched cards, or other main items of all kinds up to a given size and thickness, singles out the items arriving in any irregular sequence one below the other, unarranged and oriented on a longitudinal or transverse edge. To obtain a high singling output and draw-off quality, the items are transported in vertical position through a transport mechanism and, by using a restricting guiding unit, into the draw-off region of a draw-off belt revolving about deflection bodies tangentially toward the draw-off belt surface. In the contact zone of draw-off belt and one deflection body the inflowing mail items are pressed against the draw-off belt and only the items coming into contact with the draw-off belt directly are drawn off by friction, by deflection of these items around the deflection body.

25 Claims, 20 Drawing Figures

SEPARATING APPARATUS FOR FLAT OBJECTS

FIELD AND BACKGROUND OF THE INVENTION

The present invention relates in general to separating equipment for mail items such as letters, vouchers and the like, and in particular to a new and useful separating apparatus which hereinafter is referred to as a "singling" apparatus since its purpose is to separate and single out individual flat objects from a collection of flat objects.

SUMMARY OF THE INVENTION

It is an object of the present invention to improve the state of the art for such machines and, in particular to provide a singling apparatus for letters, vouchers, receipts, checks, punched cards, etc., that is items of any kind up to a given size and thickness. The invention singles out the items which arrive in any irregular sequence, one under the other, unarranged, and aligned on a longitudinal or transverse edge. Especially, a smooth continuous operation is to be ensured at as high an output as possible (number of singled items per unit time) even for items of very different thicknesses and surface roughnesses. At the same time it is possible to offer the singled items at irregular distances or also at approximately constant distances from each other, i.e. with a constant gap for example, to any following units (reading unit, stamping means, coding means, buffer stack and similar units) in a given suitable position.

A further object of the invention is to provide a singling apparatus for flat objects which are supplied at any interval or with at least partial mutual overlap and which are aligned on one of their edges along a feed direction, comprising guiding means defining a transport path for the objects extending in the feed direction, deflecting means having at least one movable part and for moving a belt along a draw-off path in a draw-off direction, a draw-off belt movable on said deflection means in said draw-off direction, said belt defining a contact region which is tangential to said transport path, exit means defining an exit gap with said belt on said draw-off path spaced from said contact region, and transport means for feeding objects along a transport path in the feed direction and into contact with the belt at the contact region, said deflecting means being shaped so that there results a singling of the objects by a substantially tangential admission of the objects onto said draw-off belt, said belt then moving the objects to the exit gap in the draw-off direction, whereby only the objects coming into direct contact with the moving draw-off belt are drawn off by application of the objects against the draw-off belt and by means of friction between the draw-off belt and the objects, in the draw-off direction.

The guide rollers ("deflection rollers") mentioned therein are preferred in practice, but in principle one can use other deflection means.

Accordingly, a further object of the invention is to provide a fixed curved deflection body as part of the deflection means at the contact region of the belt.

A still further object of the invention is to provide a singling apparatus which is simple in design, rugged in construction and economical to manufacture.

The various features of novelty which characterize the invention are pointed out with particularity in the claims annexed to and forming a part of this disclosure.

For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
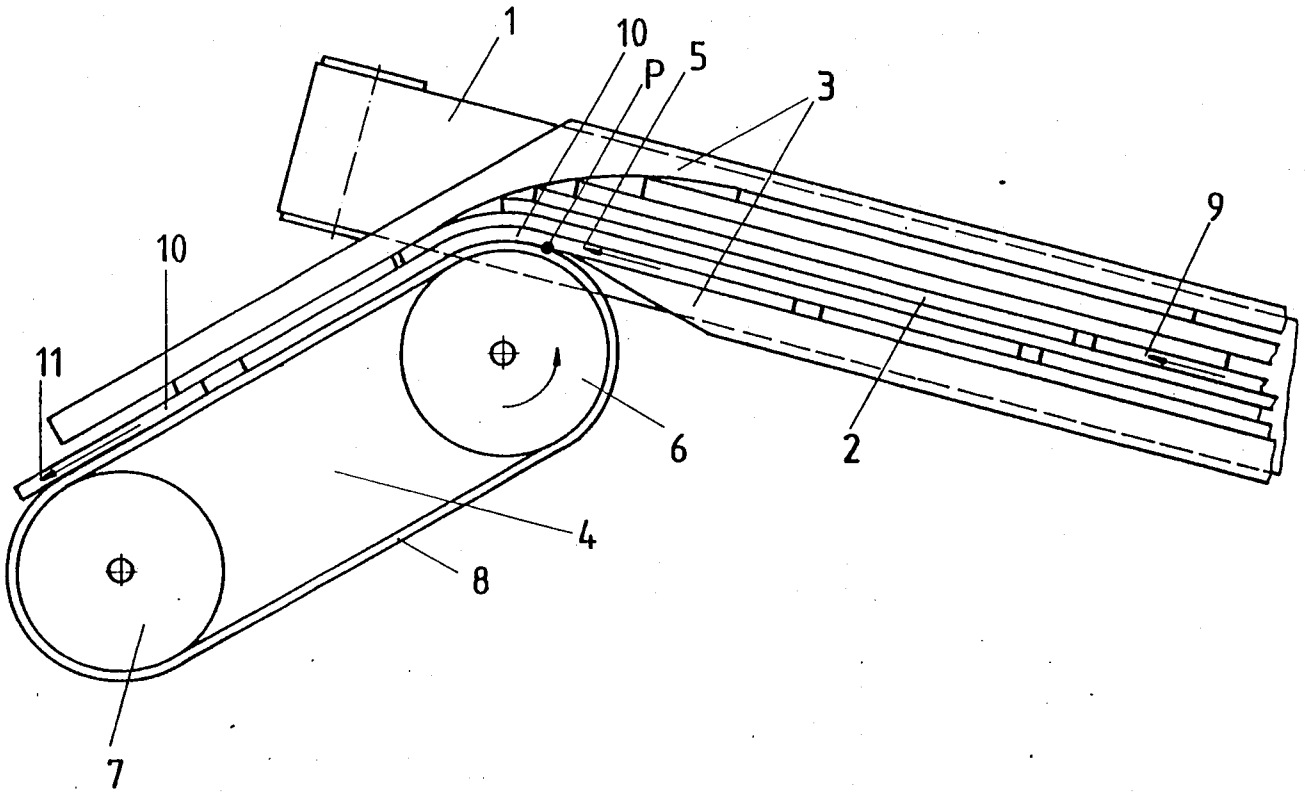
FIG. 1 is a top plan view showing the basic principle of the inventive singling apparatus.

The basic principle of the inventive singling apparatus which can be employed in an automatic letter sorting installation, is shown in FIG. 1. The mail objects such as letters, vouchers, check cards and the like, are supplied to the singling apparatus in any sequence, preferably substantially in vertical position and in an arrival or feed direction 9. The feeding can here take place, for example, from a predistribution chute in which the objects or items orient themselves unarranged in an approximately vertical position. The singling apparatus essentially contains a draw-off means 4, a guiding unit 3 and transport means 1.

The transport means 1, for example a base belt revolving about two rollers, is preferably arranged, relative to a deflection means or guide roller 6 and hence also to a draw-off belt 8 of the draw-off means 4, in such a way that the transport path 5 of the object is approximately tangential to the draw-off belt 8 on arrival of the mail object. The object or item 10, nearest to and in contact with belt 8, is seized by the draw-off belt 8 at the so-called transfer point P and is deflected from the feed direction 9 into a draw-off path extending in a draw-off direction 11 within an arc length given by the transport direction change of the object and radius of the deflection means 6 which is preferably in the form of a guide roller. During the entire draw-off process the mail items occupy an approximately vertical position, in particular in the draw-off or contact region of the draw-off means 4 around point P.

In order that there the item 10 can apply tangentially at the draw-off belt, the singling apparatus advantageously contains a guiding unit or means 3 forming with the draw-off means 4 a passage gap for the item.

The guiding unit 3 consists of a pair of guiding members 12,13 lying essentially to the right and left of the arriving items or their transport path. In the following, these members 12,13 will be called right-hand guiding member 12 and left hand guiding member 13, respectively. In the arrival region of the items the right hand guiding member 13, whose guide plane 17 stands vertically has a first portion that begins preferably before the draw-off or compact region at a distance from the draw-off region which corresponds at least to the occurring maximum item length (see FIG. 2).

To always obtain uniform optimum conditions during operation between the draw-off belt 8, the items present in the passage gap and a second portion of the right-hand guiding member 12 lying over belt 8, preferably the right-hand guiding member 12 is equipped with a pressing element 18, which displaces the right hand guiding member 12 parallel to the draw-off belt 8 until the guiding member 12 exerts on the items lying in the draw-off region and hence also on the draw-off belt 8, a pressure which is optimum for the drawing off of the item by the draw-off belt 8. To be able to draw off items of very different thicknesses, for example from 0.1 mm to 10 mm, such that the pressing element 18 which displaces the right hand guiding member 12 parallel to the draw-off belt 8 until the guiding member 12 exerts on the items lying in the draw-off region and hence also on the draw-off belt 8, a pressure which is optimum for the drawing off of the items by the draw-off belt 8. To be able to draw off items of very different thicknesses, for example from 0.1 mm to 10 mm, the passage gap should be made variable at least within this thickness range, such that the pressing element 18 causes a constant pressure preferably within this region that is optimum for the drawing off of the items lying next to the other items, and hence on the draw-off belt 8 via the guiding member 12.

The left-hand guiding unit 13 is formed for example as a metal plate, whose plane serves as an easy sliding conduction plane 15 and is arranged in a manner which is fixed toward the draw-off means 4 and in vertical position. The plane 15 is positioned in such a way that the items nearest this conduction plane 15 are, from the transfer point P on (this corresponds to the occurring contact line of the front edge of the item with the draw-off belt 8 at the beginning of the draw-off process) forced to enter the draw-off region tangentially to the draw-off belt 8.

Other items which lie parallel to the items nearest the draw-off belt, are also forced, due to friction forces occurring between the items, to enter the draw-off region.

The pressure on the right hand guiding member 12 should be chosen so high that the draw-off belt 8 can quickly draw off the nearest item without much slipping of the other items in the area.

To achieve an approximately constant pressure on the item lying on the draw-off belt, advantageously the right hand guiding member 12 is equipped with the pressing element 18 which engages, by means of a tension spring or also in the form of a weight, on the guiding member 12 and causes the guiding member 12 to rotate around a vertical axis 16 when items enter the draw-off or contact region.

Figure 2:
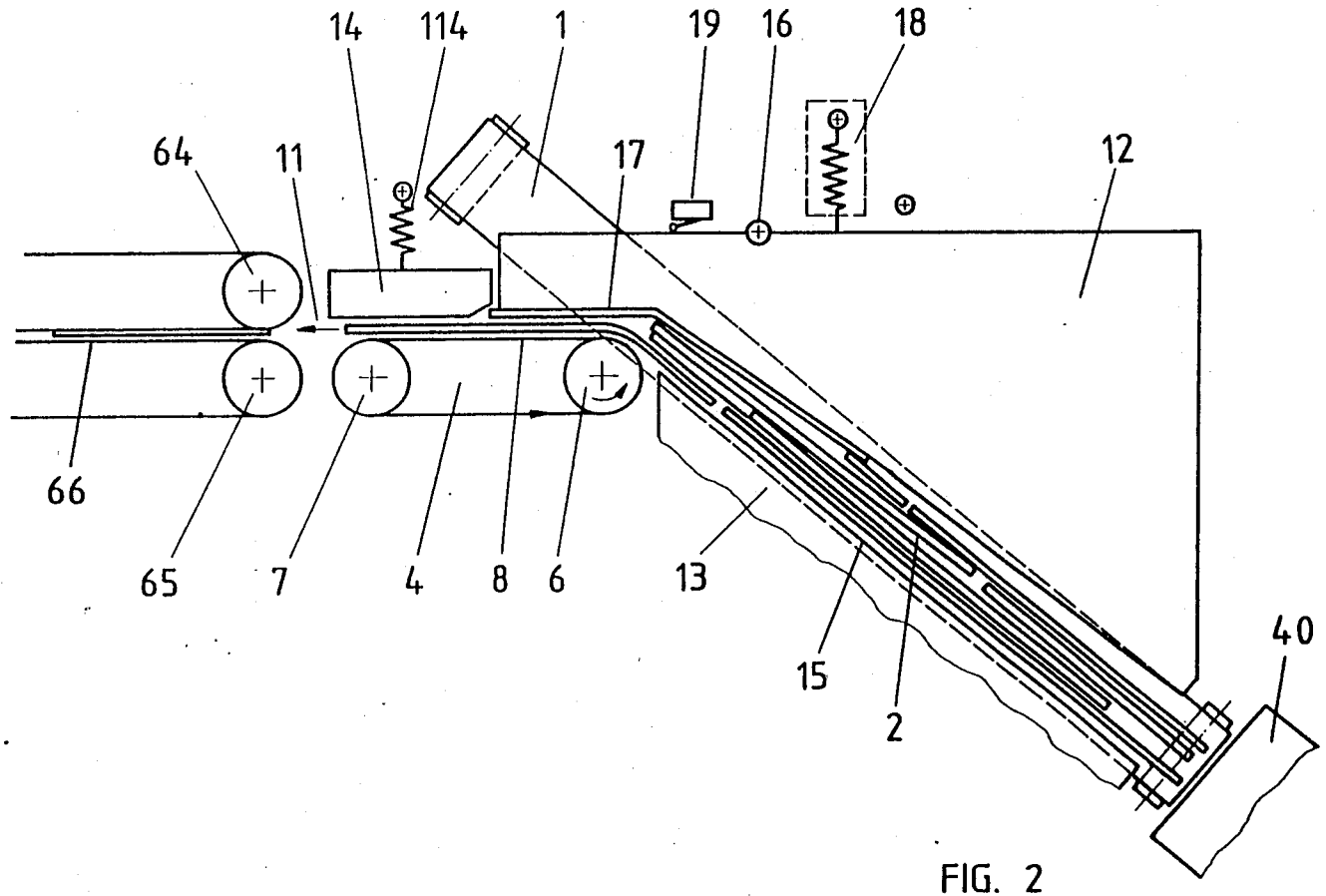
FIG. 2 is a top plan view of one embodiment of a letter singling apparatus according to the invention.

FIG. 2 shows specifically how a tension spring 18 act on the right hand guiding member 12 mounted for rotation about the pivot axis 16.

When there are no items in the draw-off region, the distance of belt 8 from the conduction plane 17 of the right hand guiding member 12 in the draw-off or contact region should be chosen at least equal to the smallest occurring item thickness, in order that also these items experience, when entering the draw-off region, through conveyor means of the transport means 1, a pressure effect sufficient for the draw-off process by the guiding member 12 against the draw-off belt 8.

In order that the pressure on the items nearest belt 8, and hence, those that are ready for draw-off, will not fluctuate too much due to the finite sliding and adhesion friction of the items perpendicular to the transport direction and the finite adjustment time of the optimum pressure during the draw-off process of the items, the passage gap in the draw-off region is chosen preferably not substantially greater than for example five times the occurring maximum item thickness.

If for example the items arrive in the draw-off region in bulk, that is, several items at the same time, and if thereby a given item thickness at the transfer point P is exceeded and the right hand guiding member 12 thus rotates correspondingly far out of its initial position, preferably the overstepping of the given maximum item thickness is recorded by means of a switching unit 19 (for example a microswitch) via the occurring angular rotation of the right hand guiding unit 12. Advantageously the switch turns the transport means and the item feeding units 40 lying therebefore, off, for example operative state "on" when a maximum item thickness is exceeded, until the maximum item thickness falls again.

Preferably there is arranged in the end or exit region of the draw-off means 4, after the right hand guiding member 12, for the avoidance of double and multiple draw-offs, a so-called stripper which extends parallel to the belt 8. A compression spring 114 biases stripper 14 so that it adjusts itself according to the thickness of the item to be drawn off, lying between the stripper region at the moment and the draw-off belt, and provides for an orderly draw-off of the item lying between draw-off belt and the stripper from the draw-off means 4. Other items lying parallel thereto are retained due to the skid or wedge form of the stripper preferably in the inflow region thereof.

Figure 3A:
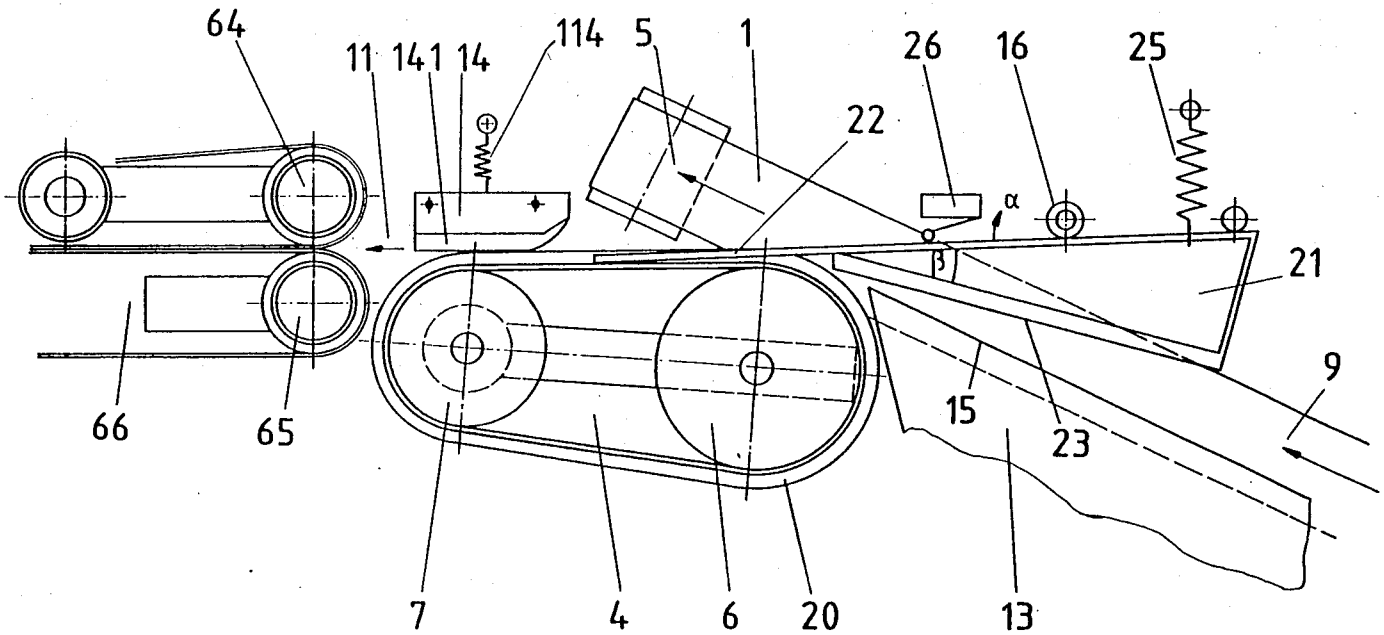
FIG. 3A is a top plan view showing a detailed design form of a guiding unit of the invention.

A stripper as described in German patent document No. P 27 04 045 can here be employed to advantage. In connection with another form of construction for the guiding unit 3, a stripper 14 is illustrated in FIG. 3A. In interaction with the other guide roller 7 of the draw-off means 4 for training the draw-off belt, the stripper 14 presses for example by means of at least one compression spring 114 (for other suitable forms see the German patent document No. P 27 04 045) the item during draw-off against, the draw-off belts or belt segments 20 in the region of the guide roller 7. This thereby prevents double and multiple draw-offs. At the same time the skid 141 of stripper 14 provided on the item side, or a guide fence disposed therebefore, facilitates a running into the passage gap formed by draw-off belt 20 and stripper 14, to a pickup region of a following transport path 66.

Preferably the springs or weights causing the contact pressure of the item on the draw-off belt 8 or 20, in conjunction with the guiding member 12, are to be formed in a bouncefree manner, i.e. damped, to permit as quick as possible an adjustment of the optimum pressure.

FIG. 3A shows a right-hand guiding member 12 designed as a bounce-free rocker which has the form of an inflow wedge 21 with a comb 22 firmly connected at the end of the wedge. The wedge angle $\beta$ is, for one thing, chosen so that the wedge flank 23 lying in the proximity of the item forms with the draw-off path or direction 11 (corresponding to the transport direction shown in FIG. 2 and 3 of the items in the transport path 66) a deflection angle of about 10° to 50°, and on the other hand so that depending on the stiffness or thickness of the items or letters to be singled, damage to or blocking of the draw-off means 4 is avoided. It is achieved thereby that the letters, supported by the transport means 1, can arrange and align themselves especially before the draw-off region.

Preferably the wedge flank 23 should form with the feed direction 9 (and hence also with the item nearest the draw-off belt 20) an acute angle of less that about 30°, which is chosen so great that for subsequent letters there is room for movement and thus a relatively small number of incoming items is present so that early blocking of the inflow wedge 21 is avoided. Also items which arrive in bulk can yield better in the wedge flank region.

The wedge flank 23 should have as low a sliding friction as possible in order that the adjacent items are not rotated by following letters. Teflon (a trade name) or materials with similar sliding properties are preferred as surfaces for wedge 21.

Figure 3B:
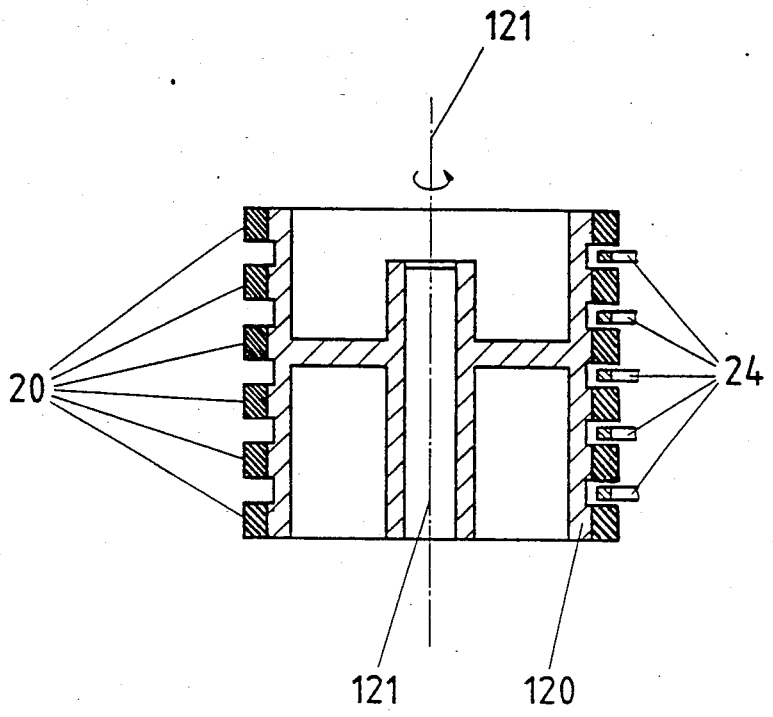
FIG. 3B is a side sectional view showing the mutual position of drawoff belts and of a comb for the guiding unit.

If the inherent motion (play) of the rocker is not negligible, in particular when very thin (less than 0.5 mm) letters are to be singled, the draw-off belt 20 of the draw-off means 4 has advantageously the form of several horizontally extending draw-off belts 20 arranged at a given spacing from each other (see FIG. 3B). The comb 22 provided at the wedge end engages preferably with its fingers 24 between the gaps of the draw-off belts 20 when no letters lie in the draw-off region. This is the inactive position. The depth of immersion is chosen so that the play (clearance) of the guiding unit 21 formed as rocker is compensated, i.e. even the thinnest letter to be drawn off which enters the draw-off means 4 experiences, via a pressing element 25 and axis 16 of the guiding unit 21, the optimum pressure for the drawing off operation. A tension spring forming element 25, transmits, via the inflow wedge 21 mounted for rotation about the pivot axis 16, the given pressure to the items lying in the draw-off region.

FIG. 3B shows a transverse section of the deflection roller body 120 with its pivot axis 121 and the draw-off belt consisting of six belts 20. In case there are no items in the draw-off region (inactive position) the fingers 24 of comb 22 dip into the gaps between the draw-off belts or belt segments 20.

To obtain an approximately constant pressure within the entire draw-off region, the curvature of the right hand guiding member 12, 21 must be adapted to the curvature of the draw-off belt 20 in the draw-off region.

Figure 4A:
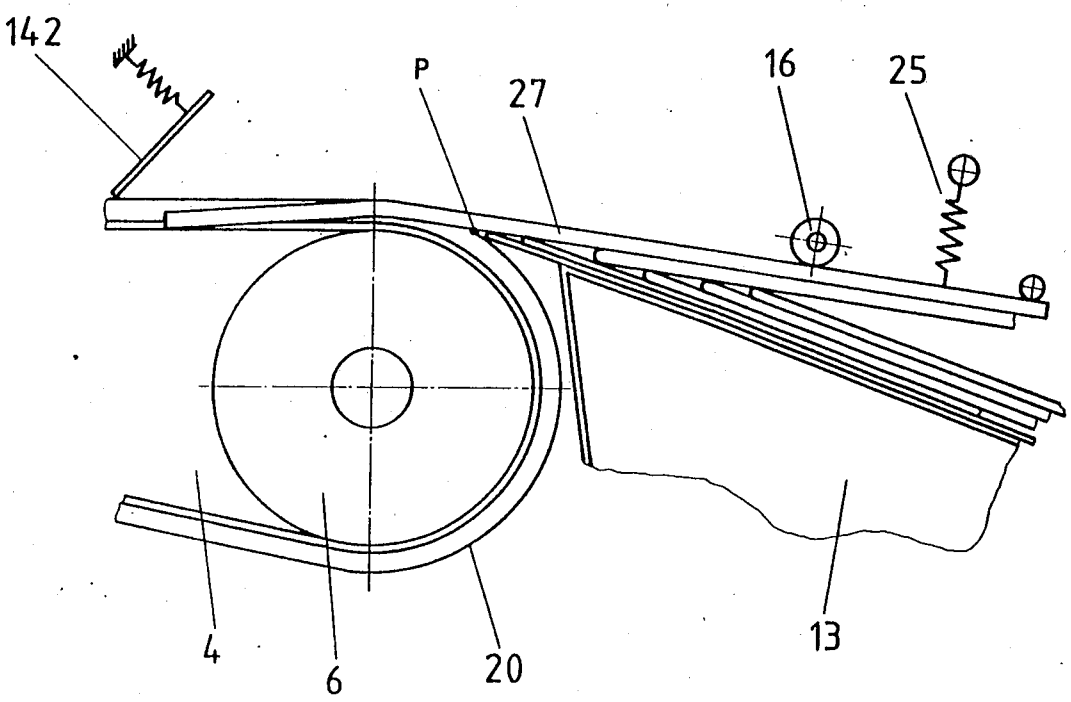
FIG. 4A is a top plan view of a special form for the rotatably mounted guiding unit adapted to the curvature of the draw-off belt surface occurring in the draw-off regions and its position relative to the draw-off belt, when there are no letters in the draw-off means.
Figure 4B:
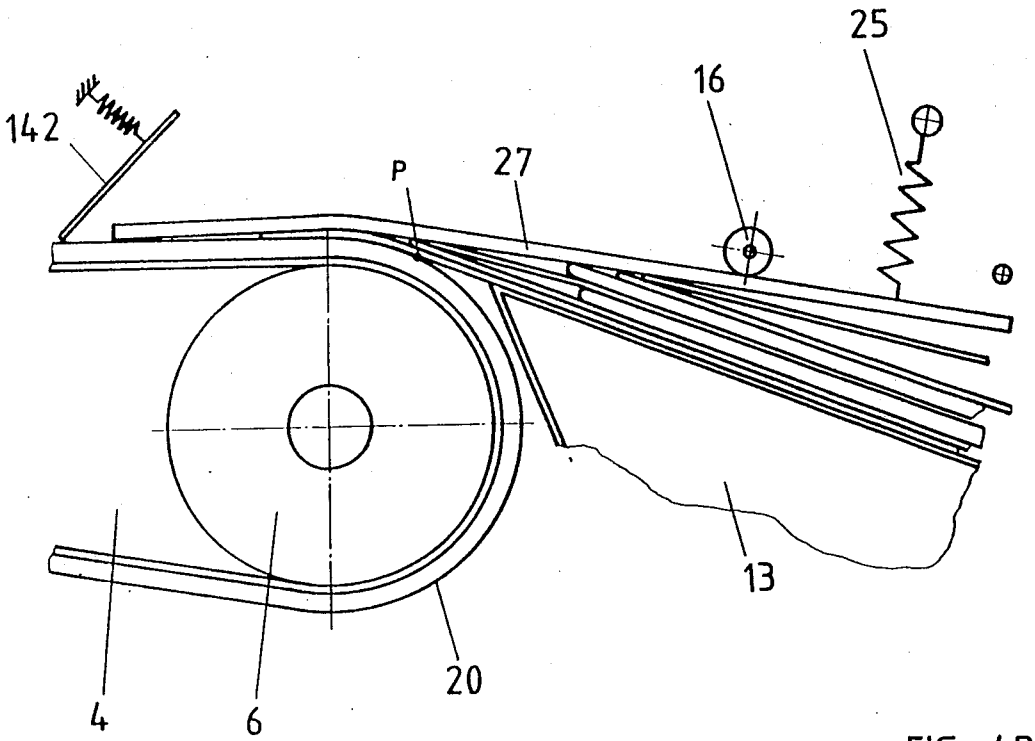
FIG. 4B is a view similar to FIG. 4A but when a letter has reached the transfer point P of the draw-off belt and is already partially drawn off.

FIG. 4A schematically shows, in top view, a preferred design for the right hand guiding member 12 in the form of a spring biased comb 27, for the case where the letters or objects have not yet reached the draw-off region, i.e. the transfer point P. FIG. 4B shows the case where a letter, namely the letter nearest the draw-off belt 20, has been seized by the draw-off belt 20 revolving about the guide roller 6 and is then drawn off around to the draw-off direction.

Figure 4C:
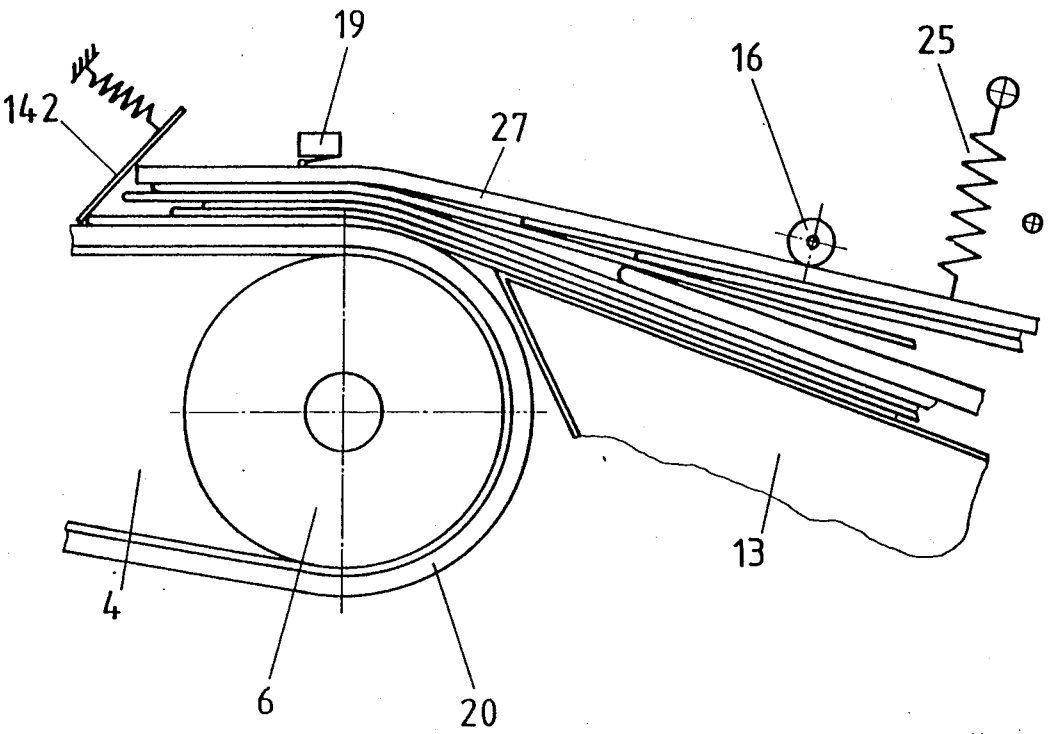
FIG. 4C is a view similar to FIG. 4 but when there are several letters in the draw-off means.

At the end of the comb 27, a sprung guiding fence 142 is shown schematically, which has mainly a guiding function but which also can avoid double or multiple draw-offs. This is necessary when, besides the letter nearest the draw-off belt, additional letters lying parallell thereto get into the linear draw-off region (see FIG. 4C).

Figure 5A:
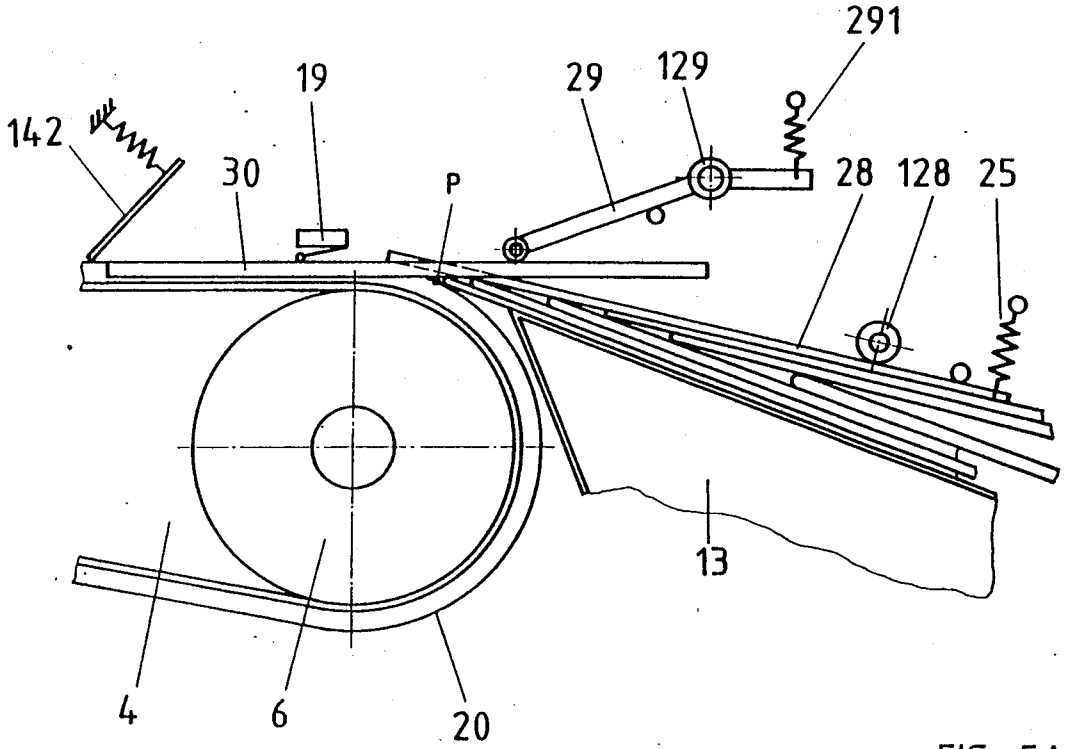
FIG. 5A is a top plan view of a guiding unit consisting of guide plates and with press-on means for each.

If additional thickness variations occur within collection of mail, preferably the guiding member 12 is designed in the form of, for example, two spring biased guide plates 28 and 30 (see FIG. 5A). Together these plates form member 12. The one guide plate 28, arranged at an acute angle to the feed or ingress direction of the letters, with tension spring 25 (or a weight for example) extends preferably as far into the draw-off region of the draw-off means 4 as the transport means for causing the transport of the letters into the draw-off means 4. While FIGS. 5A and 5B do not show the transport means 1, corresponding means are used as for example those of FIG. 3A.

FIG. 5A also shows the starting position of the guide plate 28 for the case where none of the items arriving in the draw-off region has reached the transfer point P. The other guide plate 30, mounted rotatably via a conduction arm 29 and tension spring 291, and also designed in comb form, possesses in this case an initial position lying approximately parallel to the draw-off belts 20 and forming with the draw-off belt a passage gap depending on the occurring mail thickness.

When letters pass over the transfer point P (base belt of the transport means 1 conveys letters directly or indirectly through occurring friction of the letters among themselves to the transfer point P), the guide plate 30 is rotated out of its starting position. With increasing number of arriving letters (several letters arrive in the draw-off means simultaneously) the guide plate 28 and then the comb 30 give way according to the occurring letter thickness. By the restoring force of the springs 25, 291 an approximately constant pressure on the letters is created via the guide plates 28, 30. In the equilibrium state, this can be reached as quickly as possible by means of a bounce-free layout of the biasing means, the letter nearest the draw-off belt 20 is pressed against the draw-off belt 20 with a given approximately constant pressure and is drawn off with little slip loss.

Figure 5B:
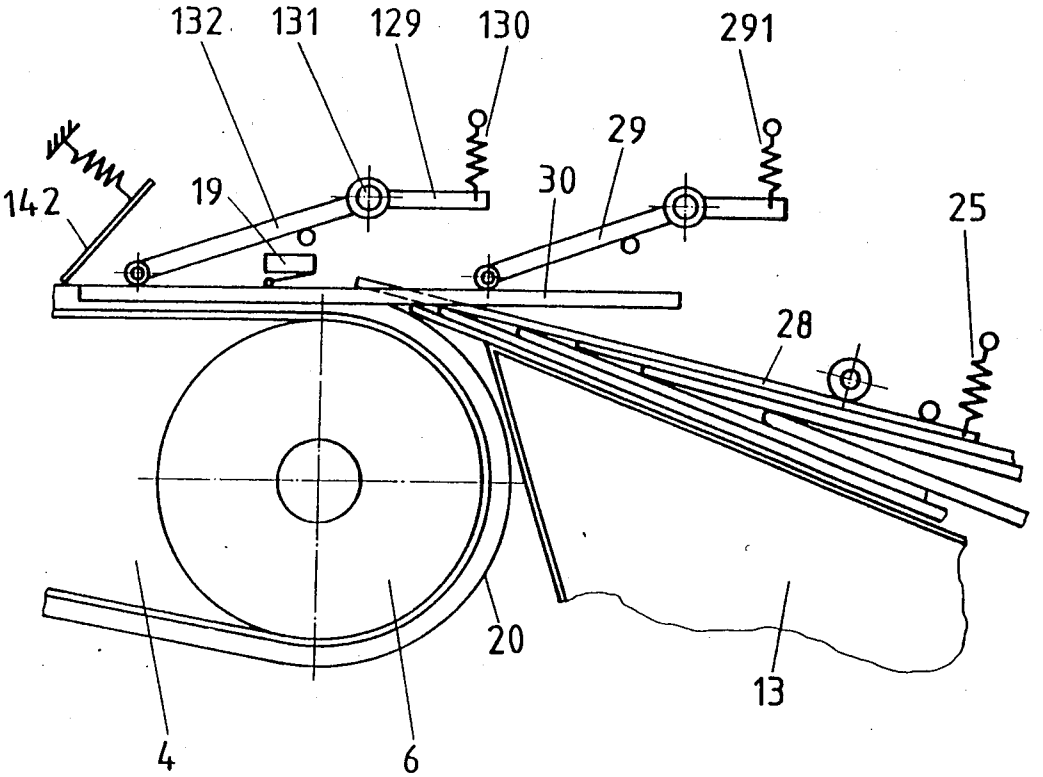
FIG. 5B is a view similar to FIG. 5A but with the guide plate arranged in a letter discharge direction and with two press-on means.

In order that letters of very different lengths within their longitudinal direction, which have for the most part assumed the final draw-off direction (linear draw-off region before the transport path 66) can be drawn off, advantageously a second pressing means 129 in the form of a conduction arm 132 mounted for rotation about the axis 131 and equipped with a spring element 130 (tensioning spring for example) is provided, which in the linear draw-off region before the transport path 66 acts on the comb of the guide plate 30 (see FIG. 5B).

Figure 6A:
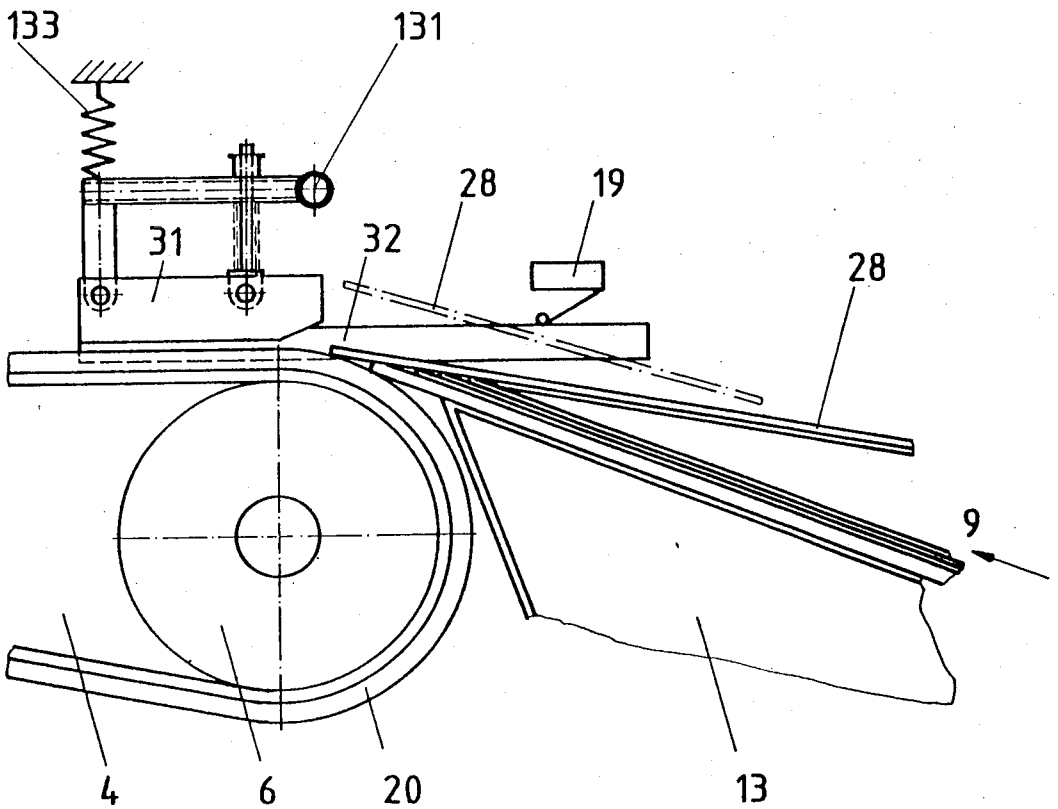
FIG. 6A is a top plan view of a guiding unit with a guide plate and a stripper, in a first case (case 1) where no letters are in the draw-off region (stripper in inactive position)
Figure 6C:
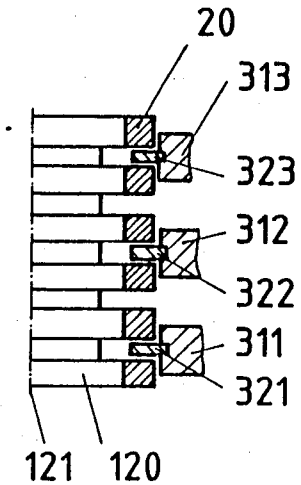
FIG. 6C is a sectional view showing the positio of the comb and of the counter-pressure element of the stripper relative to the draw-off belts for the unit of FIG. 6A.
Figure 6B:
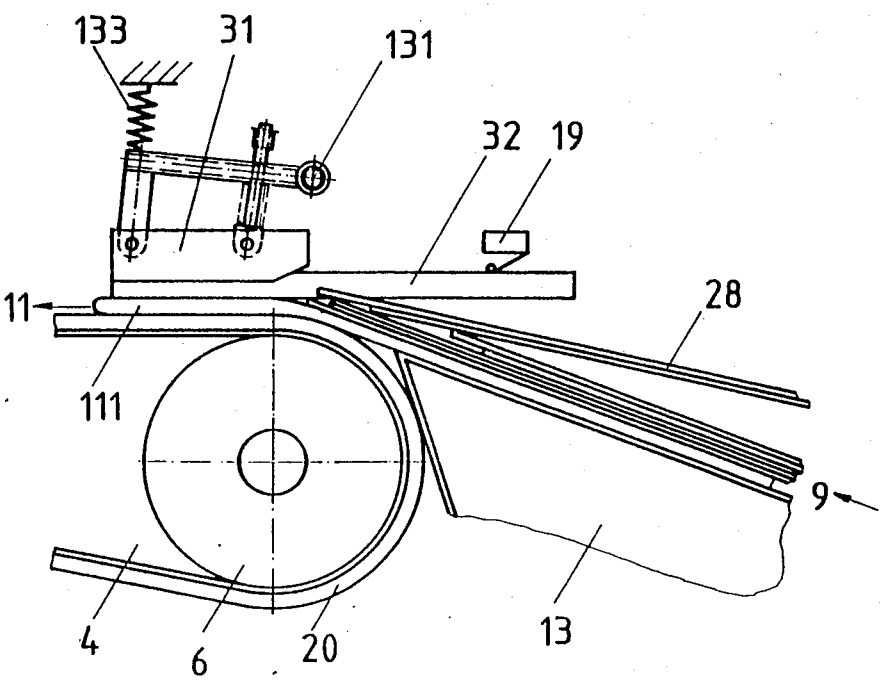
FIG. 6B is a view similar to FIG. 6A but showing a second case (case 2) where a letter is being drawn off (stripper presses letter onto the draw-off belt)

To be able to single out specifically also letters which have very different length ratios in their height, preferably the guide plate is to be designed in the form of a stripper 31 shown in FIGS. 6A and 6B, which is equipped with a comb-like guiding skid 32. The individual fingers 321, 322, 323 of the guiding skid 32 shown in FIG. 6C are firmly connected with the corresponding individually mounted counter-pressure elements 311, 312, 313 of the stripper 31 and dip, in the inactive position (when there are no mail items), into the interstices of the draw-off belt 20 consisting of several draw-off belts. The counter pressure elements 311, 312, 313 are mounted individually in order to permit an individual pressing of the fingers of skid 32 onto the letter lying in the linear draw-off region, even when the height of the letters vary. Thus also for letters with different heights the pressure of the letter on the draw-off belt can be kept approximately constant at least in a line over the entire letter height.

FIG. 6A shows the stripper 31 mounted for rotation about the axis 131 in the inactive position. The phantom lines are to indicate the position that the guide plate 28 assumes when several mail items are present in the draw-off region of the draw-off means 4.

FIG. 6B shows how torque experienced by the stripper 31 can be absorbed during the draw-off process of a letter 111 into the draw-off direction 11.

If a given mailing thickness in the draw-off region is exceeded, for example 15 mm, preferably the switch 19 is actuated, which stops the transport means 1 as well as the letter feeding units 40 (shown in FIG. 2, for example). The inactive position (no items in the draw-off region) of the guide skid 321, 322, 323, or respectively of the counter pressure elements 311, 312, 313 to the draw-off belts 20 is shown by a side view illustrated in FIG. 6C.

Figure 7:
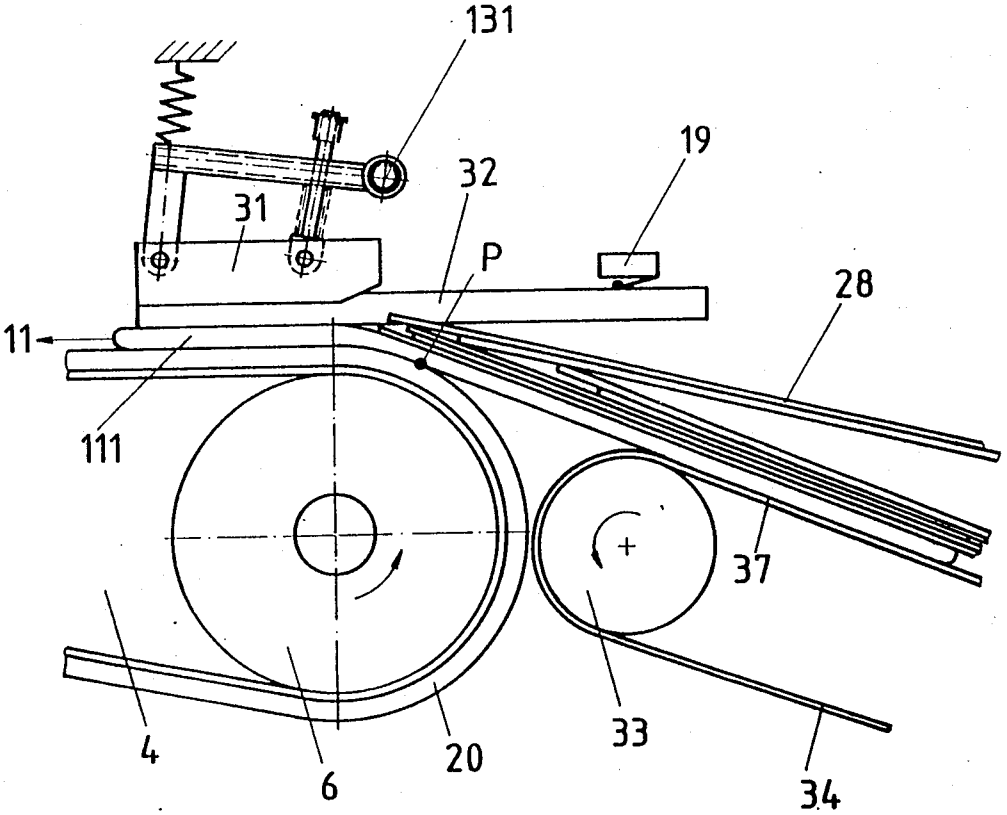
FIG. 7 is a top plan view of a guiding unit lying to the left of incoming letters, designed in the form of a side belt running in a transport direction.

In FIGS. 7 to 11, a preferred design of the left hand guiding member 13 for the proper conveyance of the letters into the draw-off means is illustrated. The guiding member 13 is realized by a side belt 34 revolving about two guide rollers 33 for example. The second guide roller is shown in FIG. 7.

Figure 8:
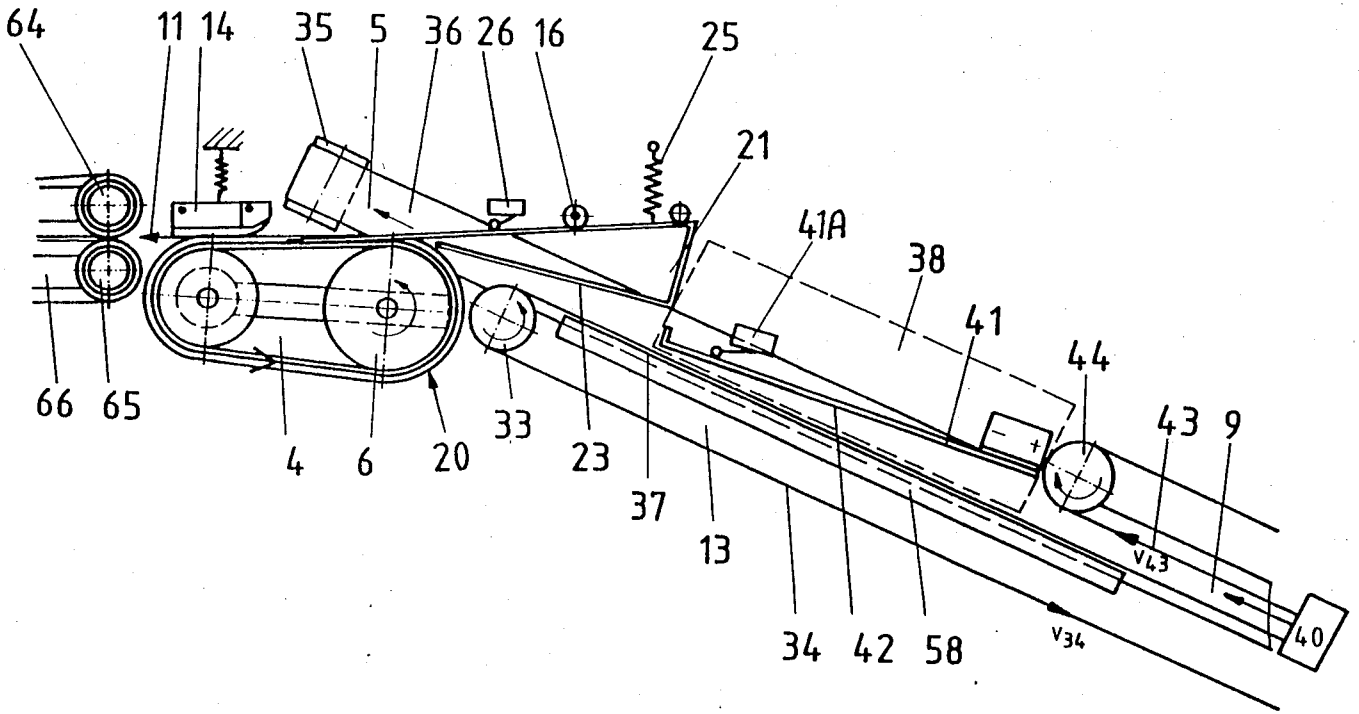
FIG. 8 is a top plan view of a letter singling apparatus with storage unit and with side belt lying to the right of the incoming letters in accordance with the invention.

Preferably the vertical position of the conduction plane 37 formed by the side of belt 34, is stabilized by means of a support wall 58 (see FIG. 8). By using a revolving side belt 34, the letters applying against the conduction plane 37 of side belt 34, which letters arrive at the transfer point P applying tangentially at the draw-off belt 20, are preferably transported into the draw-off means.

This means that the letters will not stick to the conduction plane 37 and not be rotated there by the pressure of letters moving up or respectively by differently occurring friction forces between letter/base belt and letter/side belt, about a horizontal axis. Advantageously, the belt speeds are to be selected in the order of 0.5 to 1 m per second, the speed of the transport or base belt 36 being chosen preferably greater than the speed of the left side belt 34.

Preferably an additional right hand side band 43 prevents an upward rotation of the letters on arrival (see FIG. 8). There also only one guide roller 44 is shown.

Preferably the speed $V_{34}$ of the left side belt 34 is to be chosen greater than the speed $V_{43}$ of the right side belt 43.

The speeds of the side belts and of the base belt may also be the same.

Compared with the draw-off belt 20 of the draw-off means 4, belts of little gripping power (low adhesion or sliding friction coefficient) should be used for the side belts 34, 43.

Likewise the side belts 34, 43 and the base belt 36 should have a low elasticity as well as weak dielectric properties, i.e. possess as small as possible a dielectric constant, to prevent electrostatic charge buildup of the letters.

In order that at higher letter density the letters can still be singled well in the draw-off means 4, they are briefly stored in a storage unit 38 arranged before the guiding unit 3 (FIG. 8). It is thereby prevented that more letters go to the singling operation than the draw-off means 4 can single out. The storage unit 38 contains in the vicinity of the guiding unit, sensor means which scans the arriving letter stream in its thickness and when a certain given thickness is reached turns off the letter feeding units 40 arranged therebefore via a switch.

FIG. 8 shows a structurally simple form of the storage unit 38 in combination with an inflow wedge 21. The storage unit 38 is realized by a guiding element 41, whose conduction plane 42 to the transport direction 5 (that is, to the longitudinal direction of the base belt) is arranged preferably at a more acute angle than the conduction plane 23 of the right hand guiding member of wedge 21. The guiding element 41 is mounted for example spring biased and rotatable about an axis or realized for example by a unilaterally clamped flat spring. The minimum distance of the guiding element plane 42 to the conduction plane 37 of the left side belt 34 depends on the letter thickness occurring at the moment, at the spring-loaded end of the guiding element 41. There preferably a switch **41*a* is arranged which, if a given letter thickness is exceeded, is actuated by the yielding of the guiding element 41 and thereby turns off the letter feeding units 40** arranged therebefore.

FIG. 8 shows, as has been mentioned, the storage unit 38, the guiding element 41, and an additional right hand side belt 43 revolving on guide rollers 44. Transport of the letters within the single apparatus up to the draw-off region occurs by the base belt 36 of the transport means 1, the left-hand side belt 34 of the guiding unit, and the right hand side belt 43.

To prevent the spiralling up of the letters about a horizontal axis also in the storage unit 38, preferably additional guide rollers are arranged in the storage unit 38.

Figure 9:
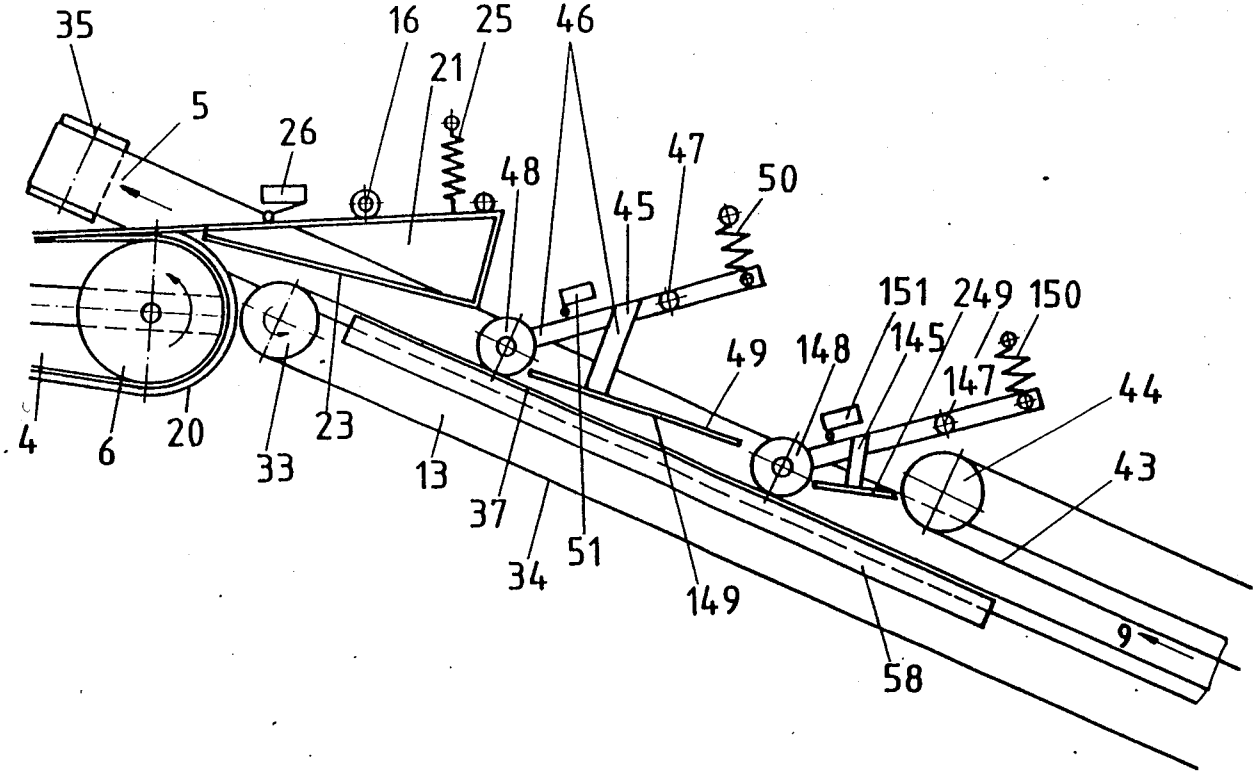
FIG. 9 is a top plan view of a letter singling apparatus with storage unit containing guide rollers.

In FIG. 9 an advantageous form of the storage unit 38 guide rollers is shown. The storage unit is designed in the form of a guide roller 48 mounted for rotation about a vertical axis 47 and a guiding element 49 arranged at an obtuse angle to the transport direction 9. They are connected together via conduction arms 46 of a rocker 45. Via the tension spring 50 of rocker 45 a constant pressure is exerted by the guide roller 48 and guiding element 49 on the mail items present in the storage unit at the site of the guide roller 48 and guiding element plane 149. The guide roller 48 itself, which is provided at one end of the conduction arm 46, is mounted for easy rotation about its axis.

FIG. 9 shows two serially arranged guide roller guiding element combinations 48, 49,45 and 148, 249, 143, each combination containing a switch 51 and 151 for the control of the letter feeding units. The positions of the guide rollers and guiding elements as illustrated in FIG. 9 correspond to the so-called inactive position (no letters in the storage unit). When mail items enter, the guide rollers and guiding elements give way by rotation of the conduction arms 46, 146 of the rockers 45, 145 about the pivot axes 47, 147.

Preferably the angle between the guiding element plane 48 and the conduction plane 37 of the draw-off belt 34 is chosen smaller than the angle of the guiding element plane of guiding element 249 and of the conduction plane 37.

Figure 10A:
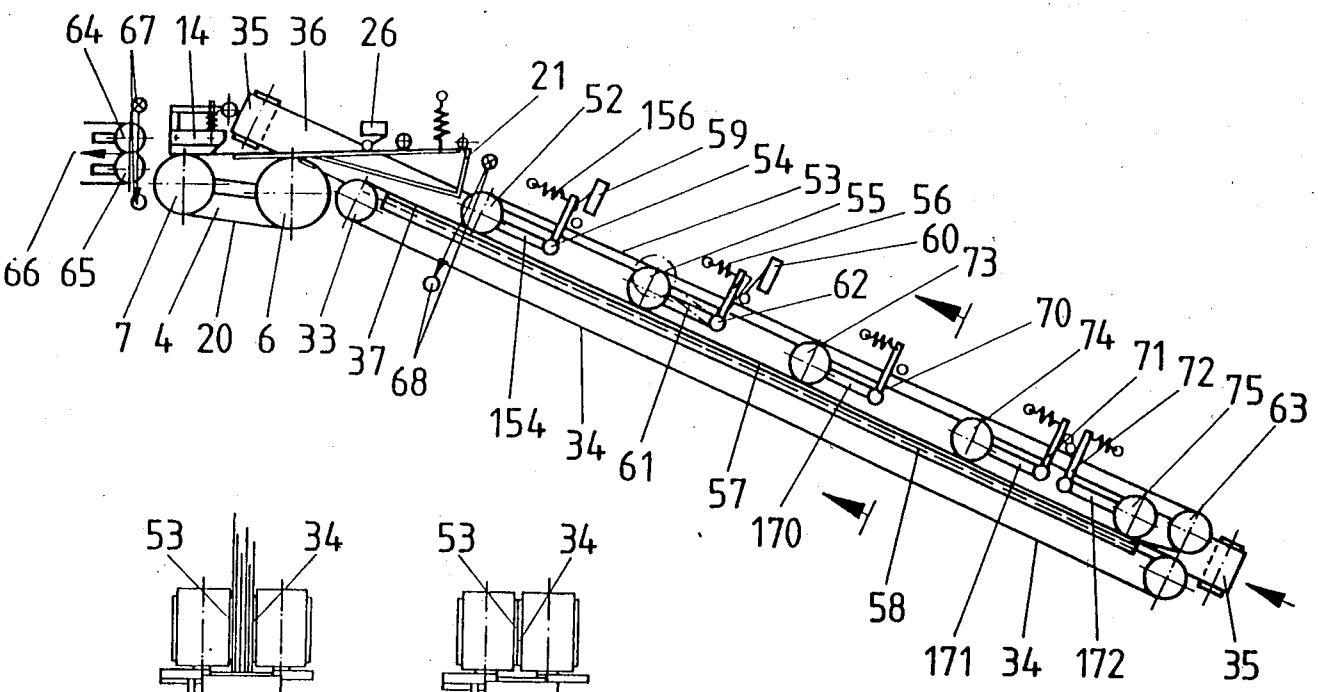
FIG. 10A is a top plan view of a storage unit equipped with a side belt and with press-on rollers.

FIG. 10A shows a form of the invention in which several sensor means equipped with switches are arranged along the storage path of the storage unit. The sensor means consist preferably of rockers 54, 62, 70, 71, 72 mounted in spring biased fashion rotatable about axes, at the conduction arm ends of which rollers 52, 55, 73, 74, 75 are rotatably fastened: They are located preferably within a side belt 53 revolving about two guide rollers 63, 52 and press onto the inner side of side belt 53 along the storage path and hence on the letters contained in the storage path. The corresponding counter pressure is absorbed by the support wall 58 situated with the left side belt 34. The tension springs active in FIG. 10A are advantageously designed so that a given approximately constant pressure of the rollers can be transmitted to the letters present in the storage unit and hence to the support wall 58, independently of the occurring thickness, i.e. the springs should have a spring constant which is as small as possible.

To get constant pressure conditions within the occurring letter thicknesses, preferably weights should be employed to produce the needed repelling forces.

Preferably the guide roller 52 nearest the right-hand guiding member 21 is also rotatably mounted and spring biased, so that it serves at the same time as sensor means before the guiding member 21. When letters enter the storage path, in particular the storage path region of the rollers 52, 55, 73, 74, 75, the rollers give way, i.e. the respective associated conduction arm 154, 61, 170, 171, 172 of the rocker carries out an angular rotation corresponding to the letter thickness occurring at the moment. If a given angular rotation at the respective location of the guide roller 52, 55 is exceeded, a switch 59 or 60 is actuated. The letter stream is controllable by the switch states of the sensor means along the storage path. For example the letter supply can be controlled thereby in such a way that an approximately constant letter stream occurs in the draw-off region. By the uniform feeding of letters into the draw-off means, the bulk type arrival of letters, which in the extreme case block the draf-off means 4, can be avoided. The advantage of the side belt 53 is (see also FIG. 9) that the spiraling up of the letters transported in the storage unit is prevented thereby, so that the inflow of the letters lying on one of their longitudinal edges into the draw-off means is ensured.

When the first drawn-off letter nearest the draw-off belt reaches the rollers 65, 64 of the transport path (one roller is mounted for example on a rocker and sprung against the counter-roller), then preferably the draw-off belt of the draw-off means 4 stops briefly. This acts as additional retention means for the next following letter nearest the draw-off belt 20 or for a letter lying between draw-off belt 20 and stripper 14. In advantageous manner this control is realized by means of a light barrier 67 arranged in the pick-up region of the rollers 64, 65 of the transport path 66 also shown in FIG. 10A.

So as to avoid excessive gaps in the feeding of mail in the region of the guiding unit 3 or 21, especially when the storage path had been idled by the switches in the draw-off region and by the switches in the storage unit (conveyor belts are standing still), there is preferably arranged in the region of the guiding unit 3 an additional light barrier 68 which cancels the switching functions of these switches in case no letters interrupt the light barrier 68. Owing to this, letters continue to be transported into the guiding unit 21 or 3 until the light barrier 68 is interrupted (see FIG. 10A).

Figure 10C:
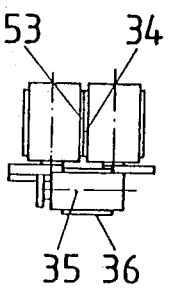
FIG. 10C is a view similar to FIG. 10B showing the belts without objects therebetween.
Figure 10B:
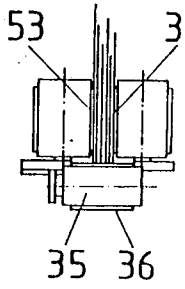
FIG. 10B is a side elevational view, partly in section of the apparatus of FIG. 10A showing a plurality of objects between side belts for transporting the objects.

FIG. 10B shows the front view of the letters lying between the right and left side belts 53,54 which rest on the base belt 36 on a longitudinal edge.

FIG. 10C shows the starting position of the rollers and respectively of the side belts 53,34 when there are no letters.

Figure 11:
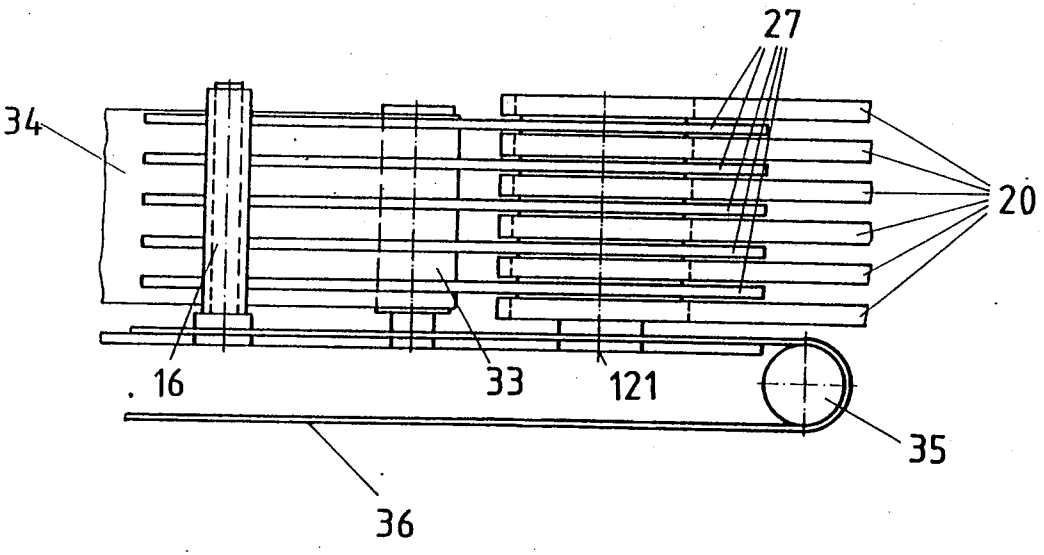
FIG. 11 is a side elevational view showing the position of the comb shown in FIG. 4A, relative to the draw-off belts and the left hand side belt.

FIG. 11 shows a side view of the comb 27 with its fingers (corresponding to the comb shown in FIG. 4) the draw-off belts 20, the left side belt 34 and base belt 36. The letters are arranged at the level of the occurring gaps of the draw-off belts 20 parallel thereto. If there are no letters in the draw-off region, they dip, as shown in FIG. 3B, between the gaps of the draw-off belts 20.

The drive of the conveyor belts (base belt and side belts) as well as the draw-off belt takes place advantageously via the guide rollers by means of electric motors which possess an electromagnetic clutch brake combination system operating with low inertia.

The draw-off belts are covered with a material of high friction coefficient. In order that the combs of the right-hand guiding unit 3 can assume a retaining function in the linear draw-off region, the guiding skids for example the fingers of the comb should preferably be formed with materials which possess a friction coefficient lying between the draw-off belts and the conduction planes arranged before the draw-off region.

In general the singling is of course possible also in that, instead of a deflection of the letters or items on a circle segment (guide roller), a deflection on a parabolic or hyperbolic path, or a combination thereof, takes place. To this end, however, the deflection body 80 shown in FIG. 12, must be fixed and the drive of the draw-off belt carried out by means of the other guide roller.

The path to be traveled in the draw-off process should be chosen according to the mail types to be singled (according to thickness, elasticity, etc.).

If stiff items are to be singled, a less curved path should be chosen. For elastic or also thin letters the curvature should preferably be chosen greater.

Figure 12:
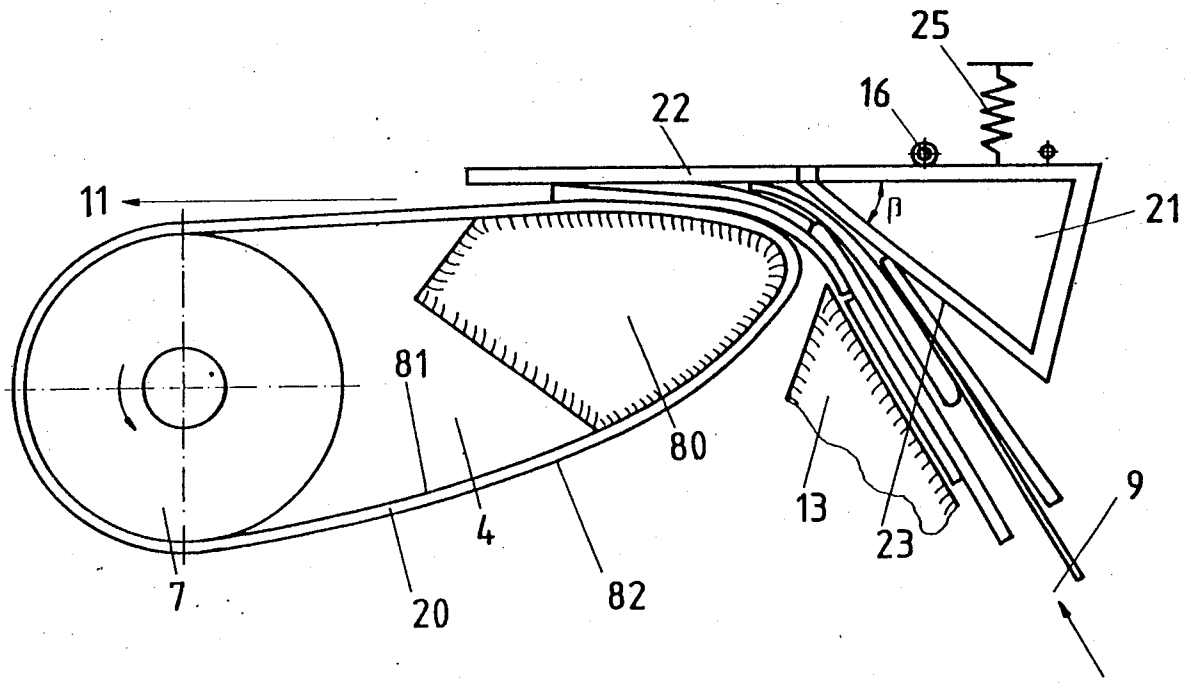
FIG. 12 is a schematic top plan view showing draw-off means with a parabolic deflection body installed in a fixed manner.

FIG. 12 shows a preferred form of the deflection body 80. For the description of a parallel path the mail items arriving in the draw-off region are deflected by means of a draw-off belt 82, which revolves about a parabolic deflection body (the generated surface of the deflection body is a parabolic cylinder). Such a form of the deflection body is a parabolic cylinder). Such a form of the deflection body has the advantage that for the items to be singled, an individually adapted path curve for the deflection can be selected. This is of great importance when extreme mail types, as e.g. items of small thickness or greatest stiffness or low surface roughness, are to be singled.

While specific embodiments of the invention have been shown and described in detail to illustrate the application of the principles of the invention it will be understood that the invention may be embodied otherwise without departing from such principles.

What is claimed is:

1. Singling apparatus for flat objects which are aligned on one of their edges along a feed direction, comprising guiding means defining a transport path for the objects extending in the feed direction, deflecting means having at least one movable part for moving a belt along a draw-off path in a draw-off direction, a draw-off belt engaged on said deflecting means and movable in said draw-off direction, said belt defining a contact region which is tangential to said transport path, exit means defining an exit gap with said belt on said draw-off path spaced from said contact region, and transport means for feeding objects along a transport path in the feed direction and into contact with the belt at the contact region, said deflecting means being shaped so that there results a singling of the objects by a substantially tangential admission of the objects onto said draw-off belt, said belt then moving the objects to the exit gap in the draw-off direction, whereby only the objects coming into direct contact with the moving draw-off belt are drawn off by application of the objects against the draw-off belt and by means of friction between the draw-off belt and the objects, in the draw-off direction, said guiding means comprising a pair of spaced guiding members lying on opposite sides of the transport path for guiding objects therebetween, said exit means comprising a stripper facing said belt, one guiding member on one side of the transport path having a first portion extending along the transport path and at least between a point corresponding to a normally occurring object length away from the contact region, to the contact region, and a second portion extending approximately parallel to the draw-off belt from the contact region to said stripper, said one guiding member being mounted for rotation about a vertical axis, a distance between said one guiding member and said draw-off belt in the contact region being at least equal to a minimum thickness for an object to be singled when there are no objects in the contact region, pressing means engaged with said one member for biasing said one member so that in the presence of at least one object in the contact region, said one guiding member executes a rotation about said vertical axis corresponding to a pressure caused by an occurring thickness of the objects arriving at the contact region and presses the object against said draw-off belt with a selected pressure, switching means engaged with said one guiding member and connected to said transport means for controlling said transport means, said switching means being engaged so that when a selected maximum object thickness is reached in the contact region, there occurs through the pickup of the rotation of said one guiding member, a switching off of the transport means, the other of said pair of guiding members being formed with a conduction plane which is fixed in tangential relationship with said contact region on said draw-off belt.

2. Singling apparatus according to claim 1, wherein said draw-off belt comprises a plurality of vertically spaced horizontally extending draw-off belt segments arranged one above the other with belt gaps therebetween, said one guiding member comprising an inlet wedge having a comb firmly connected at one end thereof, said wedge having a wedge flank with a low friction surface facing the other of said guiding members, said comb having fingers engaged between said belt gaps, said pressing means comprising a tension spring connected to said inlet wedge and biasing said fingers to said belt gaps to a selected depth to form an inactive position for said wedge where there are no objects in the contact region, and when at least one object is present in the contact region, said wedge is rotated out of the inactive position by an angle which depends on the object thickness said tension spring transmitting a pressure applied on the object to the draw-off belt segments.

3. Singling apparatus according to claim 1 wherein said one guiding member is in the form of a comb which is bent toward said draw-off belt in a manner following the curvature of a transition path for objects from said transport path to said draw-off path, said belt comprising a plurality of vertically spaced belt segments with gaps therebetween, said comb having fingers positioned at said belt segment gaps.

4. Singling apparatus according to claim 1, wherein said one guiding member has a conduction plane against which objects slide, said other guiding member having a conduction plane facing said conduction plane of said one guiding member and against which objects slide, said conduction planes of said one and other guiding members extending at an acute angle to each other in an area upstream of said contact region with respect to said feed direction.

5. Singling apparatus according to claim 1, wherein said one guiding member comprises a flat guide plate mounted for rotation about said vertical axis, said pressing means being connected to said flat guide plate for biasing said flat guide plate to pivot toward said contact region, and a comb extending over said belt and said contact region, said belt comprising a plurality of vertically spaced belt segments, said comb having fingers positioned between said belt segments, and a pivotally mounted guide arm engaged against said comb for exerting a pressure on said comb in a direction toward said contact region.

6. Singling apparatus according to claim 5, wherein said fingers of said comb comprise individual guide skids, and biasing means for individually biasing said guide skids into gaps between said belt segments.

7. Singling apparatus according to claim 1, wherein said other guiding member comprises rotatably mounted guide rollers with a side belt engaged thereon for movement in the feed direction and drive means for rotating said guide rollers at a speed which is related to a speed of said transport means.

8. Singling apparatus according to claim 7, including further guide rollers positioned upstream of said one guiding member in said feed direction and on the same side of said transport path as said one guiding member, a further side belt engaged on said further guide roller for movement in the feed direction and facing said side belt of said other guiding member for feeding objects toward said contact region.

9. Singling apparatus according to claim 8, including storage means on said transport path between said further side belt and said one guiding member for receiving plural objects before they are fed to said one guiding member and said contact region, sensor means connected to said storage means for sensing a thickness of objects in said storage means adjacent said one guiding member, said sensor means being connected to said transport means for deactivating said transport means upon the occurrence of a selected thickness of objects in said storage means.

10. Singling apparatus according to claim 9, wherein said storage means comprises at least one guiding element against which objects moving in said feed direction slide, said sensor means being engaged with said at least one guiding element, said at least one guiding element having a plane against which objects slide, said one guiding member having a conduction plane against which objects slide, said plane of said at least one guiding element being at an acute angle to said conduction plane of said one guiding member and being at a smaller acute angle to said one side belt forming said other guiding member.

11. Singling apparatus according to claim 10, wherein said at least one guiding member comprises a unilaterally clamped spring plate, said sensor means comprising a switch engaged with said spring plate at a location adjacent to said one guiding member.

12. Singling apparatus according to claim 10, wherein said at least one guiding element comprises a pressing arm mounted for rotation about vertical axis, a guide roller rotatably mounted at an end of said pressing arm closest to said one guiding member, a guiding plate connected to said pressing arm upstream of said guide roller in said feed direction, a tension spring engaged with said pressing arm for biasing said guiding plate and guide roller toward said other guiding member, said sensor means comprising a switch activatable by said pressing arm with rotation of said pressing arm when a selected thickness of objects moves between said guide roller and said other guiding member.

13. Singling apparatus according to claim 9, wherein said storage means comprises a plurality of conduction arms each pivotally mounted about a vertical axis and spaced along said transport path in said feed direction, a guide roller at an end of each conduction arm closest to said one guiding member, biasing means connected to each conduction arm for biasing each guide roller toward said other guiding member, and a further guide belt engaged on and movable over said guide rollers in said feed direction.

14. Singling apparatus according to claim 13, including a support wall engaged against said side belt forming said other guiding member on a side of said side belt opposite from said transport path for bracing said side belt toward said transport path, and switch means actuatable by rotation of said conduction arms upon the occurrence of objects having a selected thickness between said guide rollers and said side belt, for deactivating said transport means.

15. Singling apparatus for flat objects which are aligned on one of their edges along a feed direction, comprising guiding means defining a transport path for the objects extending in the feed direction, deflecting means having at least one movable part for moving a belt along a draw-off path in a draw-off direction, a draw-off belt engaged on said deflecting means and movable in said draw-off direction, said belt defining a contact region which is tangential to said transport path, exit means defining an exit gap with said belt on said draw-off path spaced from said contact region, and transport means for feeding objects along a transport path in the feed direction and into contact with the belt at the contact region, said deflecting means being shaped so that there results a singling of the objects by a substantially tangential admission of the objects onto said draw-off belt, said belt then moving the objects to the exit gap in the draw-off direction, whereby only the objects coming into direct contact with the moving draw-off belt are drawn off by application of the objects against the draw-off belt and by means of friction between the draw-off belt and the objects, in the draw-off direction, said guiding means comprising a pair of guiding members lying on opposite sides of the transport path for guiding objects therebetween, one guiding member on one side of the transport path having a first portion extending along the transport path and at least a point corresponding to a normally occuring object length away from the contact region, to the contact region, and a second portion extending approximately parallel to the draw-off belt from the contact region along the draw-off direction, said first portion extending at an acute angle with respect to said second portion of said one guiding member and at least one of said first and second portions being mounted for pivoting with respect to the transport path for accommodating between said one guiding member and the other of said guiding members flat objects of different widths and biasing means connected to said at least one of said first and second portions of said one guiding member for biasing said at least one of said first and second portions toward the other of said pair of spaced guiding members, said other of said pair of spaced guiding members extending parallel to transport path.

16. Singling apparatus according to claim 15, wherein said transport means comprises a pair of rollers spaced apart in the feed direction and a base belt movably engaged on said rollers for movement in the feed direction under said guiding means for supporting aligned edges of objects to be supplied to said contact region.

17. Singling apparatus according to claim 15, wherein said deflecting means comprises a pair of spaced apart rollers, said draw-off belt being engaged around said rollers.

18. Singling apparatus according to claim 15, wherein said one guiding member comprises a one-piece member, said first portion comprising a wedge-shaped portion and said second portion comprising a flat plate portion.

19. Singling apparatus according to claim 15, wherein said first and second portions of said one guiding member comprise separate portions, said first portion being pivotally mounted about a vertical axis and being connected to said biasing means.

20. Singling apparatus according to claim 15, wherein said exit means comprises a stripper facing said belt and being adjacent said second portion of said one guiding member.

21. Singling apparatus according to claim 15, wherein said deflecting means comprises one roller spaced from said contact region in said draw-off direction and a fixed deflection body positioned adjacent said contact region and having curved transition surface for moving objects from said transport path to said draw-off path, said draw-off belt being engaged around said deflection body and said roller.

22. Singling apparatus according to claim 21, wherein said deflection body has a parabolic or hyperbolic curved surface in said contact region around which said draw-off belt moves, said deflection body having an outer surface with a low coefficient friction.

23. Singling apparatus according to claim 15, including means defining a further transport path extending parallel to said draw-off direction and being downstream of said draw-off belt, light barrier means connected to said means defining a further transport path for sensing entry of objects from said draw-off path onto said further transport path.

24. Singling apparatus according to claim 23, wherein said guiding means comprises guide rollers on one side of said first mentioned transport path and a side belt engaged on said guide rollers and movable in said feed direction, said light barrier means being operatively connected to said guide rollers for stopping movement of said guide rollers and thus stopping of said side belt upon the lapse of a selected time or distance traveled by objects through said light barrier means.

25. Singling apparatus according to claim 23, including storage means on an opposite side of said first mentioned transport path from said side belt and upstream of said contact region for storing a thickness of objects, and additional light barrier means operatively connected to said storage means for sensing the presence of objects at said additional light barrier and operatively connected to said transport means for stopping said transport means.

* * * * *